US005467926A

United States Patent [19]

Idleman et al.

[11] Patent Number: 5,467,926

[45] Date of Patent: Nov. 21, 1995

[54] INJECTOR HAVING LOW TIP TEMPERATURE

[75] Inventors: Dennis D. Idleman, Lakeside; Douglas C. Rawlins, Murrieta; Virendra M. Sood, Encinitas, all of Calif.

[73] Assignee: Solar Turbines Incorporated, San Diego, Calif.

[21] Appl. No.: 194,769

[22] Filed: Feb. 10, 1994

[51] Int. Cl.[6] ..... F23D 11/12; F23R 3/14

[52] U.S. Cl. ..... 239/132.5; 239/400; 239/406; 239/419.3

[58] Field of Search ..... 239/400, 403, 239/405, 406, 419.3, 424, 427.3, 132.3, 132.5

[56] References Cited

U.S. PATENT DOCUMENTS

| | | | |
|---|---|---|---|
| 2,567,485 | 9/1951 | Jenny | 158/116 |
| 3,483,700 | 12/1969 | Ryberg et al. | 60/39.74 |
| 3,630,024 | 12/1971 | Hopkins | 60/39.69 |
| 3,684,186 | 8/1972 | Helmrich | 239/400 |
| 3,866,413 | 2/1975 | Sturgess | 60/39.74 |
| 3,886,736 | 6/1975 | Kawaguchi | 60/39.74 |
| 4,096,996 | 6/1978 | Ketchum, Jr. | 239/406 |
| 4,116,388 | 9/1978 | Trozzi | 239/406 |
| 4,162,140 | 7/1979 | Reed | 239/405 |
| 4,201,538 | 5/1980 | Kopp | 239/405 |
| 4,562,698 | 1/1986 | Halvorsen et al. | 239/412 |
| 4,609,150 | 9/1986 | Pane, Jr. et al. | 239/397.5 |
| 4,773,596 | 9/1988 | Wright et al. | 239/400 |
| 4,798,330 | 1/1989 | Mancini et al. | 239/8 |
| 4,962,889 | 10/1990 | Halvorsen | 239/410 |
| 4,977,740 | 12/1990 | Madden et al. | 60/39.463 |
| 5,014,918 | 5/1991 | Halvorsen | 239/410 |
| 5,062,792 | 11/1991 | Maghon | 239/405 |
| 5,218,824 | 6/1993 | Cederwall et al. | 239/419.3 |

*Primary Examiner*—Andres Kashnikow
*Attorney, Agent, or Firm*—Larry G. Cain

[57] ABSTRACT

Past fuel injection nozzles have attempted to provide a structure to reduce tip temperatures. Such nozzles have failed to attain adequate reduction of tip temperatures without increasing the quantity of cooling air required. The present fuel injector structure has resulted in reduced tip temperatures without increasing the quantity of cooling air required. The structure includes a shell having an inner member positioned therein forming a first chamber therebetween, an end piece forming a second chamber between the inner member and the end piece. An inner body has a plurality of first angled passages formed therein and communicates between the second chamber and a passage. A flow of combustor air through the second chamber contacts an air side of the end piece resulting in a combustor side being cooled. The unique structure of the fuel injector nozzle provides improved tip cooling without increasing the quality of cooling air and improves the efficiency of the gas turbine engine.

16 Claims, 4 Drawing Sheets

INJECTOR HAVING LOW TIP TEMPERATURE

TECHNICAL FIELD

This invention relates generally to gas turbine engines and more particularly to the unique structural arrangement for cooling the tip of a fuel injection nozzle in a manner such that the quantity of cooling air is minimized.

BACKGROUND ART

The use of fossil fuel in gas turbine engines results in the combustion temperatures which in many application causes premature failure of the fuel injection nozzle end through oxidation, cracking and buckling. The fuel injection nozzle end must, therefore, be cooled to increase the design life of the fuel injectors.

Attempts have been made to cool the nozzle end and increase the life of such components. One such example, of a nozzle which has attempted to cool the end thereof is disclosed in U.S. Pat. No. 4,600,151 issued Jul. 15, 1986 to Jerome R. Bradley. The injector assembly includes a plurality of sleeve means one inside the other in spaced apart relation. An inner air-receiving chamber and an outer air-receiving chamber for receiving and directing compressor discharge air into the fuel spray cone and/or water or auxiliary fuel from the outside for mixing purposes. The air streams exit directly into the combustor zone wherein mixing with fuel and combustion occurs.

Another attempt to cool a nozzle is disclosed in U.S. Pat. No. 4,483,137 issued Nov. 20, 1984 to Robie L. Faulkner. This cooling system includes a central air passage and a twofold air flow directed by a secondary air swirl vane and a radially extending swirl vane. Each of the air streams exit directly into the combustion zone wherein mixing with fuel and combustion occurs.

Many of the cooling schemes of the past discharge the spent cooling air into the combustion chamber where it can adversely affect the combustion process. In the invention described herein the cooling air flow becomes a part of the combustion air prior to entering the combustion chamber. Therefore, its effect on the combustion process in general and NOx and CO emissions in particular is minimized. Furthermore, the quantity of cooling air is held to a minimum while effectively cooling the tip of the injector nozzle.

DISCLOSURE OF THE INVENTION

In one aspect of the invention, a fuel injection nozzle is comprised of means for delivering premixed primary air and combustion fuel through the fuel injection nozzle, means for delivering pilot fuel through the fuel injection nozzle, means for delivering pilot combustion air through the fuel injection nozzle and an end piece being cooled by the pilot combustion air prior to being mixed with the pilot fuel and passing through the fuel injection nozzle during operation thereof.

In another aspect of the invention, a fuel injection nozzle is comprised of a shell having an inner member positioned therein forming a first chamber therebetween. An end piece has a bore therein and defines a combustor side and an air side. The end piece is connected to the shell and forms a second chamber between the inner member and the end piece. The second chamber is in fluid communication with the first chamber. An inner body is positioned inwardly of the inner member and the inner body has a bottoming bore therein which is in communication with the passage in the end piece. Means for delivering air has a portion of the flow of air in communication with the air side prior to exiting the passage and contacting the combustor side during operation of said fuel injector nozzle.

BEST MODE FOR CARRYING OUT THE INVENTION

Figure 1:
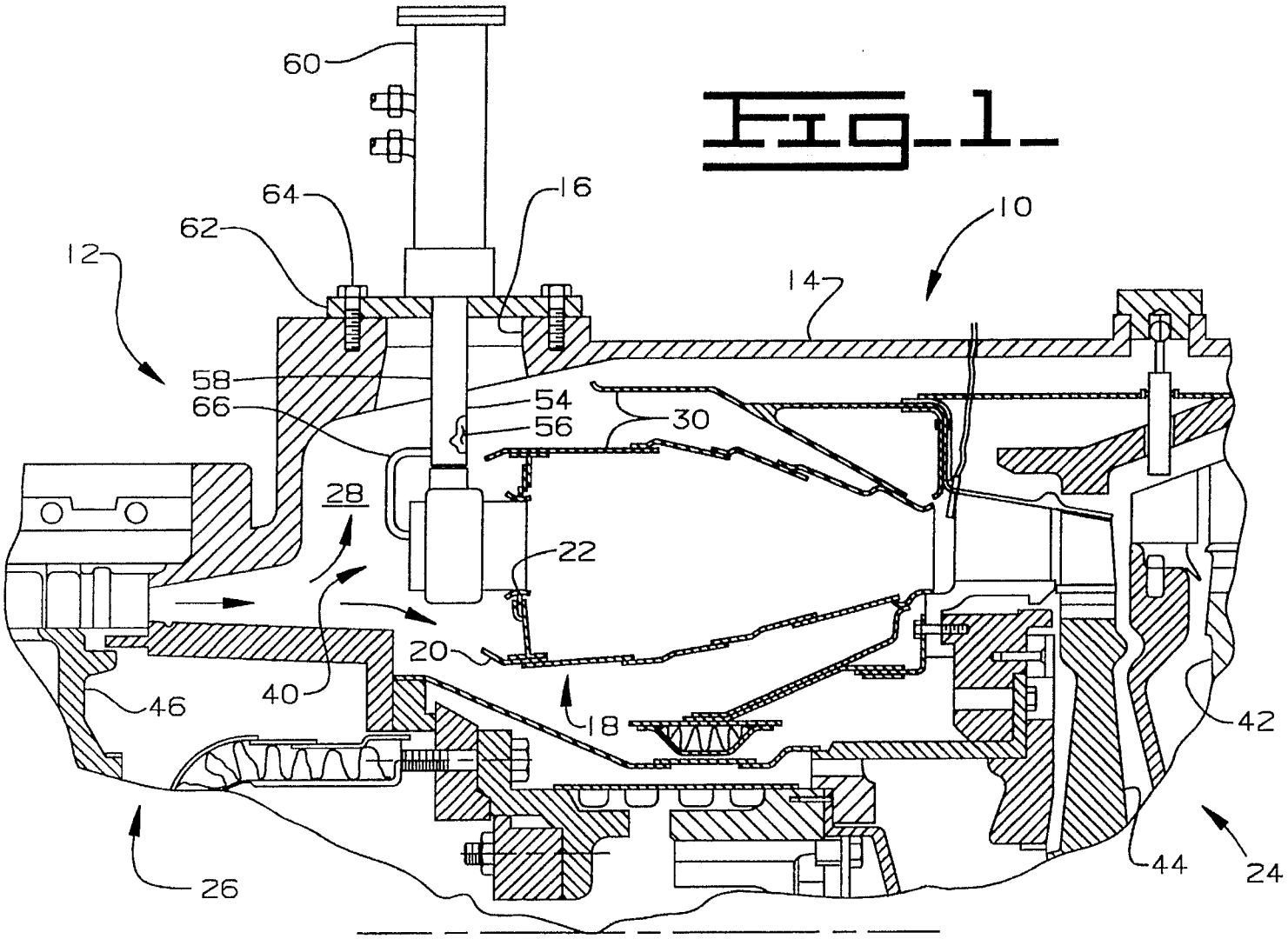
FIG. 1 is a partially sectioned side view of a gas turbine engine having an embodiment of the present invention.

Referring to FIG. 1, a gas turbine engine 10, not shown in its entirety, has been sectioned to show an air delivery system 12 for cooling engine 10 components and providing combustion air. The engine 10 includes an outer case 14 having a plurality of openings 16 therein, of which only one is shown, a combustor section 18 having an inlet end 20 defining an injector opening 22 therein, a turbine section 24, a compressor section 26, and a compressor discharge plenum 28 interposed the compressor section 26 and the combustor section 18 and fluidly connecting the air delivery system 12 to the combustor section 18. The plenum 28 is partially defined by the outer case 14 and a multipiece inner wall 30 partially surrounding the turbine section 24 and the combustor section 18. A plurality of fuel injection nozzles 40 (of which only one is shown) are positioned partially within the plenum 28 and the combustor section 18.

The turbine section 24 includes a power turbine 42 having an output shaft, not shown, connected thereto for driving an accessory component such as a generator. Another portion of the turbine section 24 includes a gas producer turbine 44 connected in driving relationship to the compressor section 26. The compressor section 26, in this application, includes a multistage compressor 46, although only a single stage is shown. When the engine 10 is operating, the compressor 46 causes a flow of compressed air. As an alternative, the compressor section 26 could include a radial compressor or any source for producing compressed air.

In this application and best shown in FIG. 1, each of the fuel injection nozzles 40 is removably attached to the outer case 14 in a conventional manner. The fuel injector nozzle 40 includes an outer tubular member 54 having a passage 56 therein. The outer tubular member 54 includes an outlet end portion 58 and an inlet end portion 60. The outer tubular member 54 extends radially through one of the plurality of openings 16 in the outer case 14 and has a mounting flange 62 extending radially therefrom. The flange 62 has a plurality of holes therein in which a plurality of bolts 64 threadedly attach to a plurality of threaded holes spaced about each of the plurality of openings 16 in the outer case 14. Thus, the injector 40 is removably attached to the outer case 14. The passage 56 has a tube 66 therein being in fluid communication with a source of fuel not shown.

Figure 2:
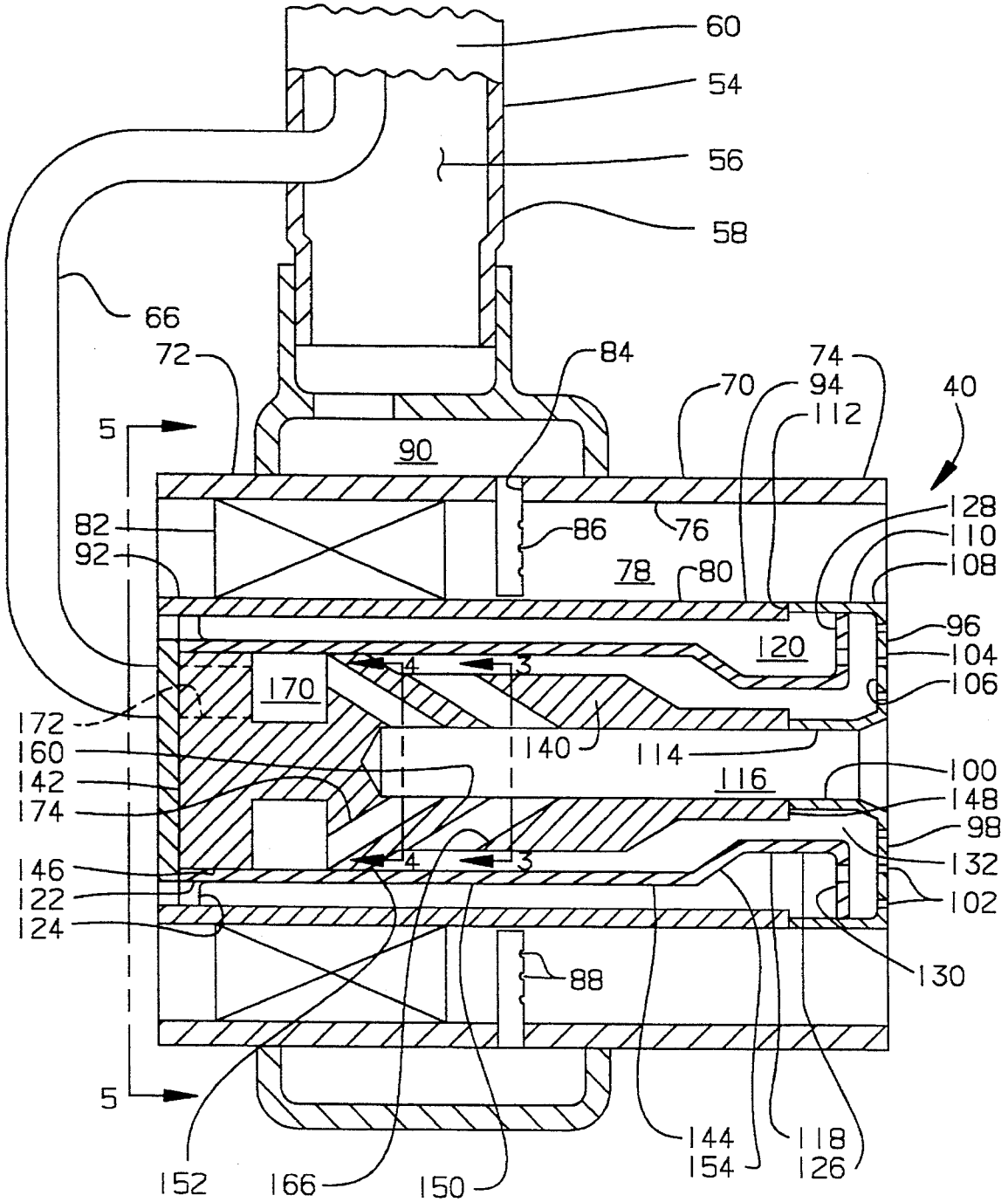
FIG. 2 is an enlarged sectional view of a fuel injection nozzle disclosing one embodiment of the present invention.
Figure 3:
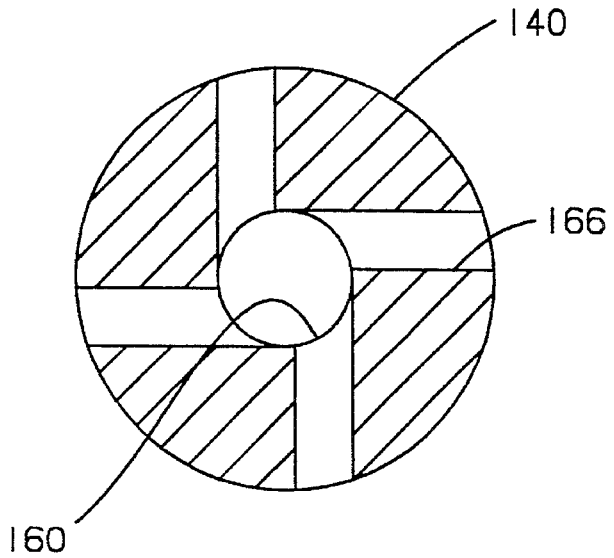
FIG. 3 is an enlarged sectional view taken along line 3—3 of FIG. 2.
Figure 4:
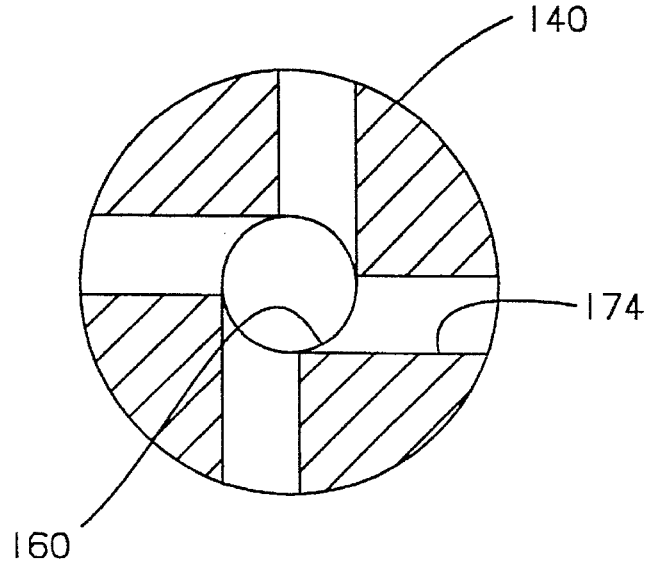
FIG. 4 is an enlarged sectional view taken along line 4—4 of FIG. 2.
Figure 5:
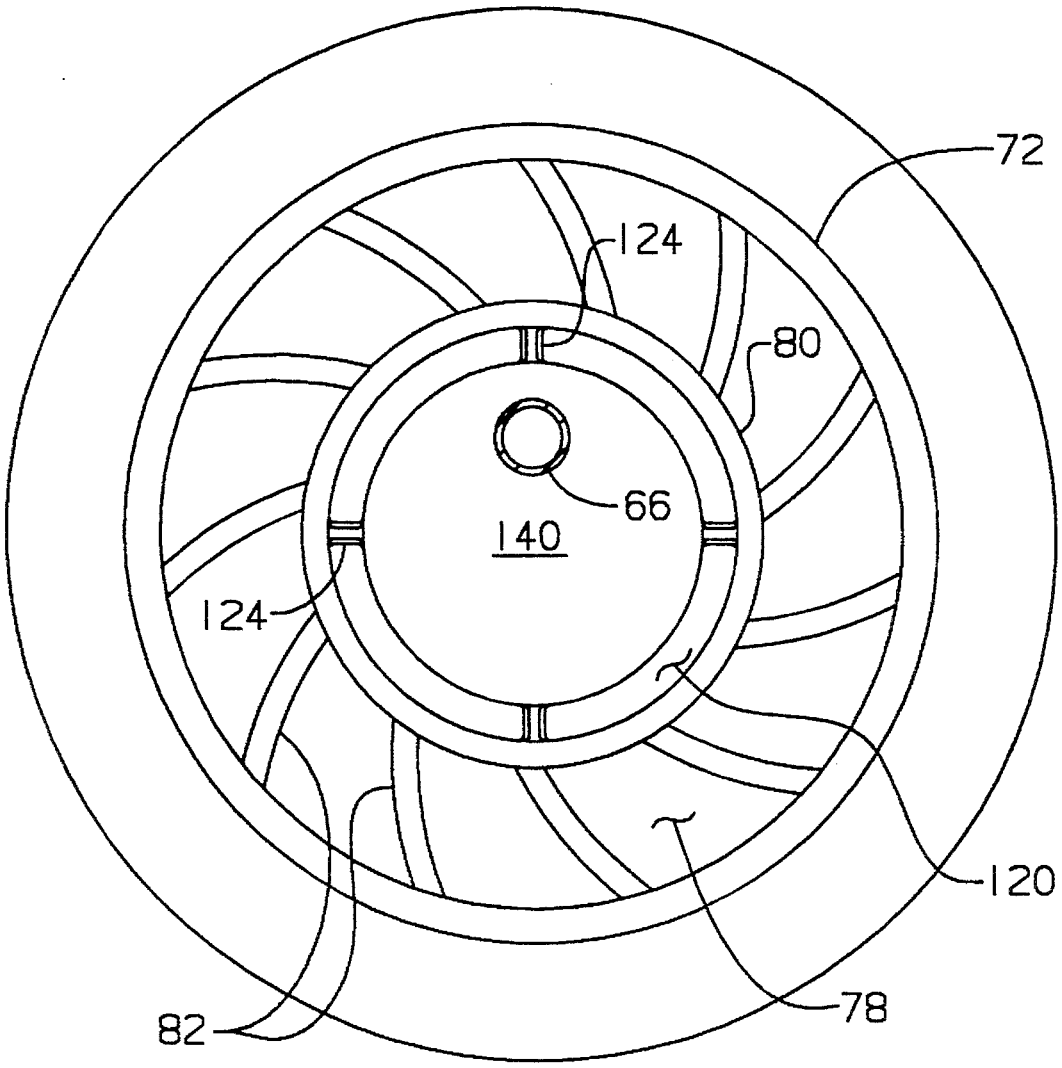
FIG. 5 is an enlarged view of the upstream end of the fuel injector.

As further shown in FIG. 2, the injector opening 22 is a generally cylindrical outer member 70 having a first end portion 72 and a second end portion 74 defined thereon. The tubular member 54 is interposed the first and second end portions 72,74 and is attached to the outer member 70. An inner surface 76 is defined on the outer member 70. An annular passage 78 is formed between the inner surface 76 and a generally cylindrical shell 80. The shell 80 is spaced radially inwardly from the inner surface 76 a predetermined distance. Positioned in the annular passage 78 near the first end portion 72 is a plurality of swirler vanes 82. A plurality of holes 84 are positioned intermediate the swirler vanes 82 and the second end portion 74 of the outer member 70. Each of the holes 84 has a fuel injection spoke 86 positioned therein. Each spoke 86 extends radially inward from the inner surface 76 a predetermined distance. A plurality of openings 88 are radially positioned along the axis of each of the spokes 86. The plurality of openings 88 communicate with the fuel from the tube 66 by way of an annular passage 90.

The cylindrical shell 80 has a first end portion 92 and a second end portion 94 defined thereon. The second end portion 94 has a generally cylindrical cup shaped end piece 96 attached thereto. The end piece 96 includes a base portion 98 having a bore 100 center therein and a plurality of effusion cooling holes 102 positioned therein in a preestablished manner. The base portion 98 defines a combustor side 104 and an air side 106 and has an outer surface 108 radially extending from the center of the bore 100. A first upstanding cylindrical wall 110 extends from the air side 106 of the base portion 98 at the outer surface 108. An end portion 112 of the first upstanding wall 110 is attached to the second end portion 94 of the shell 80. A second upstanding cylindrical wall 114 extends from the air side 106 of the base portion 98 forming a passage 116 therein.

Positioned within the shell 80 and a portion of the first upstanding wall 110 is a generally cylindrical inner member 118 being generally spaced from the shell 80 and defining a first chamber 120 therebetween. The inner member 118 has a first end portion 122 being generally offset with the extremity of the first end portion 92 of the shell 80. A plurality of tabs 124 are positioned near the first end portion 122 retain the shell 80 and inner member 118 in spaced relationship. The first chamber 120 extends axially from the air side 106 of the end piece 96 to the first end portion 122 of the inner member 118. A second end portion 126 of the inner member 118 is axially spaced from the first end portion 122 and has a flange 128 extending radially outward in contacting relationship with the first upstanding wall 110 of the end piece 96. The flange 128 has a plurality of holes 130 therein which communicate with the chamber 120. Interposed the flange 128 of the inner member 118, air side 106 of the end piece 96 and the second upstanding wall 114 of the end piece 96 is a second chamber 132 which further extends axially from the air side 106 of the end piece 96 toward the second end portion 122 of the inner member 118. The second chamber 132 is in communication with the plurality of holes 130. An inner body 140 is positioned within the cylindrical inner member 118 and defines a first end 142. An outer surface 144 of the inner body 140 has a generally stepped configuration which defines a first surface 146 in sealing contacting relationship with the inner member 118 positioned near the first end 142 and progressing toward a second end 148 of the inner body 140 a preestablished distance. The second end 148 is attached to the second upstanding wall 114 in sealing relationship. A second surface 150 is interposed the first surface 146 and the second end 148. The second surface 150 has a smaller diameter than the first surface 146 and has a first blending portion 152 connecting the first surface 146 with the second surface 150. A second blending portion 154 connects the second surface 150 with the second end 148 of the inner body 140. A bottoming bore 160 is positioned in the inner body 140 and extends from the second end 148 toward the first end 142. The bottoming bore 160 is communicated with the passage 116. Communicating between the second chamber 132 and the bottoming bore 160 are a plurality of first angled passages 166. The plurality of first angled passages 166 extend from the second surface 150 nearest the first end 142 and angles inwardly toward the second end 148 and intersect the bottoming bore 160 tangent thereto. Means 168 for delivering pilot combustion air to the combustor section 18 includes the first chamber 120, the plurality of holes 130, the second chamber 132, the plurality of first angled passages 166, the bottoming bore 160 and the passage 116. An annular groove 170 is positioned in the inner body 140 near the first end 142 and extend inwardly from the first surface 146. The annular groove 170 is interposed the first end 142 and the first blending portion 152. A bore 172 extends from the first end 142 of the inner body 140 into the annular groove 170. An end of the tube 66 is in communication with the bore 172. A plurality of second angled passages 174 are positioned in the inner body 140 and communicate between the annular groove 170 and the bottoming bore 160. The plurality of second angled passage 174 extend from the annular groove 170 inwardly toward the second end 148 and intersect the bottoming bore 160 tangent thereto. The plurality of second angled passages 174 are interposed the plurality of first angled passages 166 and the annular groove 170. Means 180 for delivering pilot fuel to the combustor section 18 includes the fuel tube 66, the bore 172, the annular groove 170, the plurality of second angled passages 174, the bottoming bore 160 and the passage 116.

Means 190 for delivering premixed air and combustible fuel includes the annular passage 78 having the plurality of swirler vanes 82 positioned therein and the spokes 86 through which primary fuel for combustion is introduced into the annular passage 78.

INDUSTRIAL APPLICABILITY

In use, the gas turbine engine 10 is started in a conventional manner. In this application, for pilot operation, fuel, which is a gaseous fuel, is introduced through the tube 66 and is introduced into the annular groove 170. The gaseous fuel travels through the four second angled passages 174 into the bottoming bore 160 to be mixed with pilot combustion air prior to entering the combustion section 18 and acting as the pilot. Pilot combustion air is introduced into the fuel injector 40 through the first gallery 120, passes through the plurality of holes 130, enters the second gallery 132, through the first angled passages 166 mixing with the fuel in the bottoming bore 160 and the mixture of fuel and air exits through the passage 116 into the combustion section 18.

The combination of the first angled passages 166 being angled and tangent to the bottoming bore 160 and the second angled passages 174 being angled and tangent to the bottoming bore 170 causes the fluids exiting therefrom to be in a state of high turbulence which creates eddies which induce a high degree of mixing between the air and the fuel. Thus, a homogeneous mixture of pilot fuel and air is introduced into the combustion section resulting in a good burning mixture which results in low emissions.

Furthermore, in this application, for primary operation, fuel, which is a gaseous fuel, is introduced into the annular passage 90. The fuel enters into the spokes 86 and exits the plurality of passages 88 into the annular passage 78. Primary combustion air enters into the annular passage 78 passes through the swirler vanes 82 and mixes with the gaseous fuel from the spokes 86. The homogeneous mixture of primary gaseous fuel and air is introduced into the combustion section resulting in a good burning mixture which results in low emissions.

The flow path of the pilot combustion air after passing through the plurality of holes 130 into the second gallery 132 takes a split path. A portion of the pilot combustion air which is in contact with the air side 106 of the end piece 96 cools the end piece 96. Since the air side 106 is opposite the combustor side 104, heat from the end piece 96, due to combustion taking place on the combustor side 104, is transferred to the pilot combustion air within the second gallery 132. Thus, the pilot combustion air becomes a heat recipient fluid and cools the end piece 96 of the fuel injector 40. Another portion of the pilot combustion air flows through the plurality of effusion cooling holes 102 in the base portion 98 of the end piece 96. The effusion cooling holes 102 provide an air-sweep which interfaces the end piece 96 and the hot combustion gases in the combustion section 18, thus, cooling the combustion side 104 of the end piece 96. The effect of the dual path being that the longevity of the fuel injector 40 is prolonged, life is improved and down time is reduced. Furthermore, since the pilot combustion air is used as the coolant additional cooling air is not needed to cool the fuel injector 40. Therefore, engine efficiency is increased resulting from the use of combustor air as the coolant prior to being introduced into the combustor section 18.

The present fuel injector 40 structure has resulted in an injector having reduced NOx and CO emissions, improved tip cooling and increased engine efficiency. The position of the combustion air flow path and the tangentially intersecting with the bottoming bore 160 and the angle of the first and second angled passages 166,174 have created this unique structure. Thus, the use of the above described fuel injector nozzle 40 has resulted in reduced NOx and CO emissions and increased engine efficiency.

Other aspects, objects and advantages will become apparent from a study of the specification, drawings and appended claims.

We claim:

1. A fuel injection nozzle comprising:

means for delivering premixed primary air and combustion fuel through the fuel injection nozzle during operation thereof;

means for delivering pilot fuel through the fuel injection nozzle;

means for delivering pilot combustion air through the fuel injection nozzle during operation thereof; and an end piece having a combustion side and an air side positioned opposite the combustion side, said combustion side being cooled by said pilot combustion air being in contacting relationship with said air side prior to being mixed with said pilot fuel and passing through the fuel injection nozzle during operation thereof.

2. The fuel injection nozzle of claim 1 wherein said means for delivering premixed primary air and combustion fuel through the fuel injection nozzle includes an annular passage having a plurality of swirlers positioned therein and a plurality of spokes through which primary fuel for combustion is introduced into the annular passage.

3. The fuel injection nozzle of claim 1 wherein said means for delivering pilot fuel through the fuel injection nozzle includes a bore, an annular groove, a plurality of second angled passages, a bottoming bore and a passage.

4. The fuel injection nozzle of claim 1 wherein said means for delivering pilot combustion fuel includes a first chamber, a plurality of holes, a second chamber, a plurality of first angled passages, a bottoming bore and a passage.

5. A fuel injection nozzle comprising:

a shell having an inner member positioned therein forming a first chamber therebetween;

an end piece having a bore therein and defining a combustor side and an air side, said end piece being connected to the shell and forming a second chamber between the inner member and the end piece, said second chamber being in fluid communication with the first chamber;

an inner body being positioned inwardly of the inner member, said inner body having a bottoming bore therein being in communication with the passage in the end piece; and means for delivering air, said means for delivering having a portion of the flow of air being in communication with the air side prior to exiting the passage and contacting the combustor side during operation of said fuel injector nozzle.

6. The fuel injector nozzle of claim 5 wherein said communication between the second chamber and the bottoming bore includes a plurality of first angled passages extending therebetween.

7. The fuel injector nozzle of claim 6 wherein said plurality of first angled passages are tangent to the bottoming bore.

8. The fuel injector nozzle of claim 7 wherein said inner body defining a first end and a second end, said plurality of first angled passages extending near the first end and angles inwardly toward the second end.

9. The fuel injector nozzle of claim 5 wherein said communication between said first chamber and said second chamber includes a plurality of holes positioned in the inner member.

10. The fuel injector nozzle of claim 5 wherein said means for delivering air includes said first chamber, a plurality of holes interposed the first chamber and the second chamber, said second chamber, a plurality of first angled passages interposed the second chamber and the bottoming bore, said bottoming bore and said passage.

11. The fuel injector nozzle of claim 5 further including means for delivering combustible fuel being positioned generally within said shell.

12. The fuel injector nozzle of claim 11 wherein said means for delivering combustible fuel includes an annular groove being positioned in the inner body, a plurality of second angled passages being in communication with the annular groove and the bottoming bore.

13. The fuel injector nozzle of claim 12 wherein said plurality of second angled passages are tangent to the bottoming bore.

14. The fuel injector nozzle of claim 7 wherein said inner body defining a first end and a second end, said plurality of second angled passages extending near the first end and angles inwardly toward the second end.

15. The fuel injector nozzle of claim 5 wherein said end piece includes a plurality of effusion cooling holes therein.

16. The fuel injector nozzle of claim 15 wherein said means for delivering combustion air having a portion of the flow of combustion air exiting through the plurality of cooling holes and contacting the combustor side during operation of said fuel injector nozzle.

* * * * *